United States Patent [19]

Killarney

[11] Patent Number: 4,967,043

[45] Date of Patent: Oct. 30, 1990

[54] ABSORBING OVERTRAVEL IN SEQUENTIAL SWITCHING

[75] Inventor: Declan E. Killarney, Naperville, Ill.

[73] Assignee: Eaton Corporation, Cleveland, Ohio

[21] Appl. No.: 358,280

[22] Filed: May 30, 1989

[51] Int. Cl.[5] ..... H01H 9/00; H01H 13/00

[52] U.S. Cl. ..... 200/1 B; 200/402; 200/339; 200/17 R

[58] Field of Search ..... 200/1 B, 5 R, 17 R, 200/18, 6 A, 408, 438, 6 R, 6 C, 402, 339

[56] References Cited

U.S. PATENT DOCUMENTS

| | | | |
|---|---|---|---|
| 2,901,568 | 8/1959 | Goff | 200/1 BX |
| 3,413,430 | 11/1968 | Sharples | 200/1 B |
| 3,879,592 | 4/1975 | Comerford et al. | 200/438 |
| 4,280,027 | 7/1981 | Comerford et al. | 200/6 A |
| 4,668,843 | 5/1987 | Watanabe | 200/1 BX |
| 4,760,221 | 7/1988 | Yoshida et al. | 200/408 |
| 4,795,862 | 1/1989 | Linden | 200/6 A |

*Primary Examiner*—J. R. Scott

*Attorney, Agent, or Firm*—R. A. Johnston

[57] ABSTRACT

A switch assembly having first and second snap acting switches sequentially actuated by user movement of a single rocker which contains a cantilever blade spring for effecting actuation of the first switch; and, upon continued user movement of the rocker overtravel of the first snap acting switch is absorbed by resilient movement of the cantilever blade member.

15 Claims, 2 Drawing Sheets

ABSORBING OVERTRAVEL IN SEQUENTIAL SWITCHING

BACKGROUND OF THE INVENTION

The present invention relates to sequential actuation of the plurality of control switches for effecting user desired functions, as for example, user selected raising and lowering of door windows in a motor vehicle by power-driven actuators. Typically, rocker-type actuated switches are provided in a passenger vehicle for selective actuation of various control function in the vehicle such as window lift motors. In such applications it is necessary or desirable to actuate the plurality of switches sequentially by a single actuator or rocker. Where a single rocker is employed to effect lowering of a passenger vehicle door window by an electric actuator motor and it has been desired to provide for continuous operation of the motor by user of the rocker actuator to a second position which is tactilely sensed. In the aforesaid type actuator movement where the user tactilely senses a second position of the rocker, the second position may be the point of sequential actuation of a second snap acting switch.

However, when plural switches are sequentially actuated by continued movement of a single rocker-type actuator, the switch first actuated must absorb the overtravel of the rocker which occurs between the actuation of the switches. Where snap acting switch mechanisms are employed in this type of arrangement, the overtravel which occurs in the first actuated switch has been found to be sufficiently substantial to cause excessive deformation of the blade members of the snap acting switch. This deformation has resulted in a shift in the actuating point of the switch; and, in some cases has resulted in permanent damage sufficient to render the switch subsequently inoperable.

Thus, it has been desired to provide a switch actuator mechanism operable for effecting, from a single rocker-type actuator, sequential actuation of plural snap acting switches in such a manner that the continued movement of the rocker actuator after the trip point of the first to be actuated of the switches does not create sufficient overtravel of the actuated switch to damage the switching mechanism. It has particularly been desired to find a way of actuating a pair of switches sequentially in rapid succession with a single actuator and to provide a tactilely sensed indication of the actuation of the second switch which is distinct from that of the first switch.

SUMMARY OF THE INVENTION

The present invention provides a switch assembly of the type user actuated by movement of a single rocker-type actuator for providing sequential actuation of a plurality of switches. The present invention provides for closely spaced or rapid sequential operation of a pair of snap-action switches from a single rocker-type actuator in which the user can tactilely sense the actuation of the first and second switches separately by the change in force on the actuator.

The present invention provides a single rocker-type actuated switch assembly having a resilient blade spring on the actuator wherein a first switch is actuated upon user movement of the rocker; and, upon continued movement after actuation of the first switch, a second switch is actuated with the overtravel after actuation of the first switch absorbed by deflection of a cantilever blade spring mounted the rocker. The change in force caused by resilient deflection of the cantilever blade spring is tactilely sensed by the user to provide an indication of actuation of the second switch. The switch assembly of the present invention is particularly suitable for automotive power lift window applications where it is desired to actuate a second snap action switch with the same actuator for providing a continuous operating mode for lowering the window enabling the user to remove pressure from the switch rocker and have the window continue to be lowered by the servo motor.

DETAILED DESCRIPTION

Figure 1:
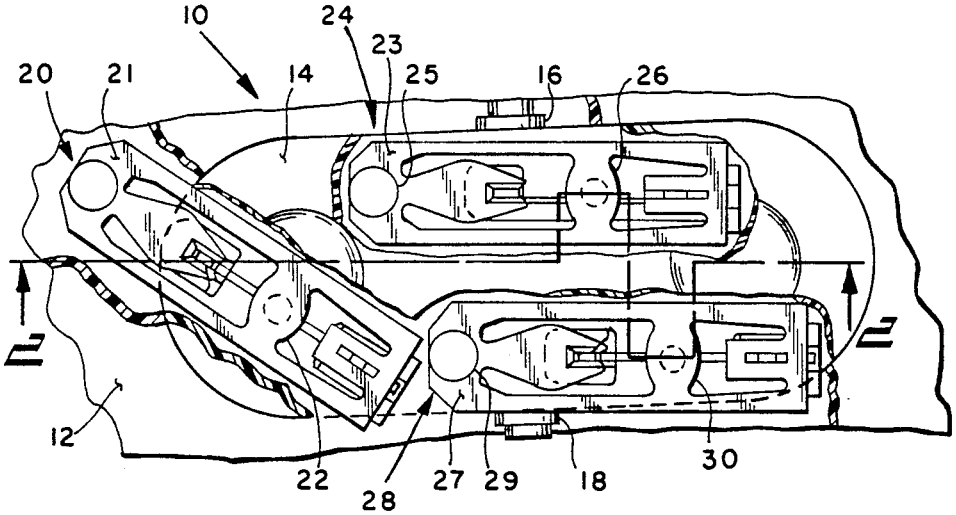
FIG. 1 is a plan view of the switch assembly of the present invention with portions of the rocker and housing broken away.

Referring to FIG. 1, the switch assembly of the present invention is indicated generally at 10 as having a housing or base 12, shown broken away in FIG. 1, having an elongated rocker actuator 14, also shown broken away in FIG. 1, which is mounted on the base 12 pivotally about trunnions 16, 18.

Base 12 has mounted thereon a plurality of snap acting switches, one of which indicated generally at 20 is intended for actuation by rocker 14 to energize an automotive window lift servo motor for raising the window. Switch 20 is positioned beneath the rocker 14 for actuation by application of a force from the rocker at the switch region denoted 22 of switch blade member 21 which is illustrated only in FIG. 1.

The second switch indicated generally at 24 having a movable blade member 23 with two-sided transfer contact 25 thereon is disposed for actuation by application of a force from rocker 14 thereto in the region denoted 26 on of blade 23 the opposite side of trunnion 16 from switch 20.

A third switch indicated generally at 28 having movable blade member 27 with two-sided transfer contact 29 thereon is disposed in generally parallel relationship with the switch 24 for actuation by application of a force from the rocker applied in the region indicated at 30 of blade 27. In the present application of the switch assembly of the present invention, switch 24 is an "express down" function switch for maintaining an automotive window lift motor continuously energized for lowering the window after user release of the rocker. Switch 28 is employed for maintaining power to a window lift motor by manually holding the rocker depressed to effect motor rotation in the direction to lower the window; and, upon release of actuation force thereagainst the switch 28 deactuates to stop motor rotation. In the aforementioned type of application, once switch 24 has been actuated, an electronic circuit (not shown) maintains power to the window lift motor in a direction to effect continued downward movement thereof despite deactuation of the switch 24.

Figure 2:
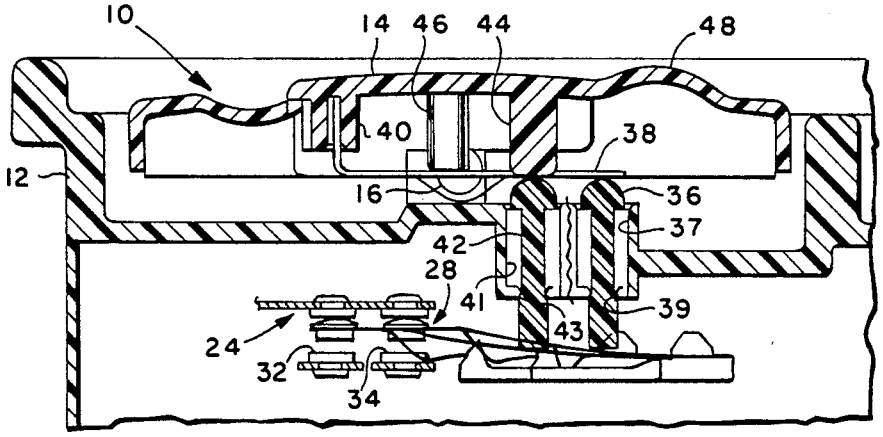
FIG. 2 is a section view taken along section indicating lines 2—2 of FIG. 1.

Referring to FIG. 2, the switch assembly of FIG. 1 is shown in cross-section with "up" switch 20 omitted for clarity of illustration. The rocker actuator 14 is illustrated in FIG. 2 in the neutral or "at rest" position prior to application of any actuation force thereto by the user. In the position of the switch illustrated in FIG. 2, the express down switch 24 and the down switch 28 are both in the unactuated or normally open condition with the transfer blade 23, 27 of each moved to a position where electrical continuity by transfer contact 23 with a lower contact 32 of switch 24 and by transfer contact 29 contact 34 of switch 28 is broken.

A force transfer member 36 is slidable mounted on the base 12 and guided for vertical movement thereon by guide surfaces 37 and 39 for contacting the actuation region 30 of blade member 27 of switch 28 for, upon movement, effecting actuation of the switch 28.

An overtravel absorbing blade spring 38 is mounted in cantilever on the attachment portion 40 provided on the underside of actuator 14 with the free end of the blade spring 38 disposed for contact with the upper end of force transfer member 36 which preferably has a rounded end as illustrated in the drawings.

A second force transfer member 42 is slidably mounted for vertical movement on base 12 by guide surfaces 41 and 43 and is disposed with the lower end thereof positioned for the actuation region 26 of "express down" switch 24. Force transfer member 42 also has the upper end thereof rounded. A rigid contact portion 44 also depends from the underside of rocker 14 and has the lower end thereof positioned for contacting the upper rounded end of force transfer member 42.

A rigid stop 46 also depends from the underside of rocker 14 and provides a support fulcrum for the blade spring 38.

Figure 3:
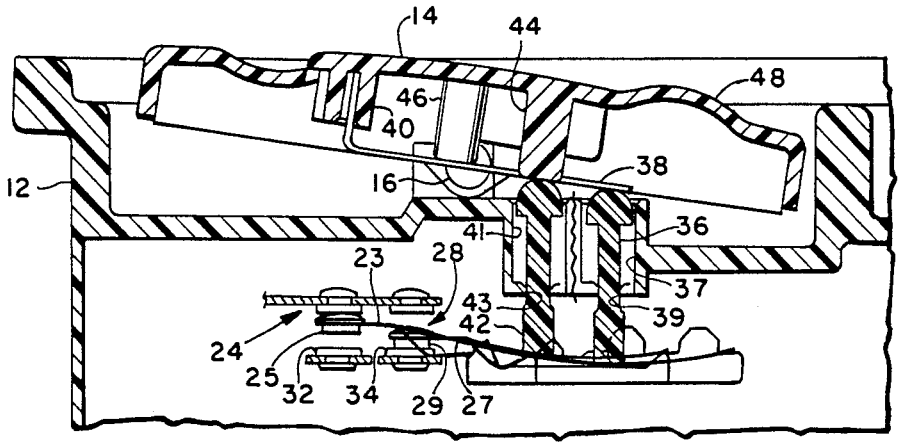
FIG. 3 is a view similar to FIG. 2 with the actuator moved to actuate one of the switches.

Referring to FIG. 3, the actuator 14 is shown rotated about trunnion 16 by user application of force to the domed portion 48 of the actuator; and, blade spring 38 contacts stop 46 and is stiffened thereby sufficiently to depress force transfer member 36 downwardly to effect tripping or actuation of switch 28 to close a circuit between transfer contact 29 and the lower contact 34. With the actuator in the position shown in FIG. 3, the rigid portion 44 of the actuator has not been moved about trunnion 16 an amount sufficient to cause any appreciable movement of the force transfer member 42.

Figure 4:
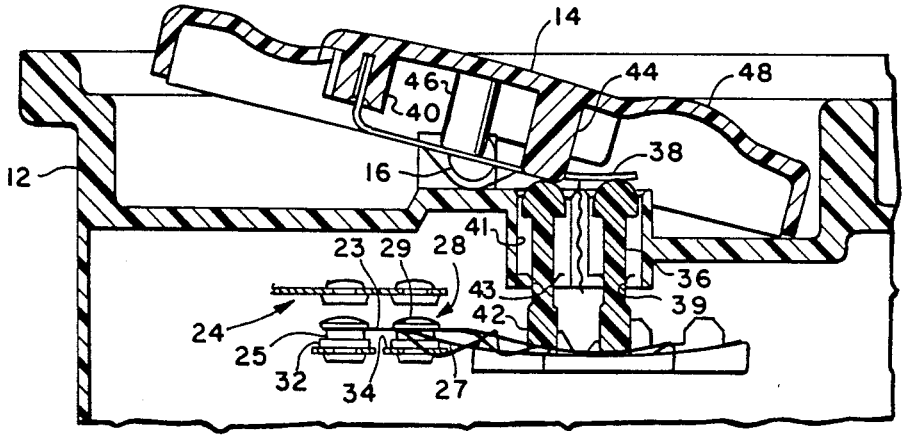
FIG 4 is a view similar to FIG. 4 showing the actuator moved to a position actuating two of the switches.

Referring to FIG. 4, the actuator 14 has been rotated about trunnion 16 an additional amount, by continued user pressure on the dome 48, such that the resistance of the actuator region 30 of blade 27 of switch 28 has caused the cantilever blade spring 38 to be deflected upwardly about rigid post 46. The blade spring 38 when deflected as shown in FIG. 4 is thus absorbs the overtravel of actuator 14 by resilient deflection of the blade spring 38 rather than further unwanted movement or deflection of the switch actuator region 30 of blade member 27 of switch 28. In the position shown in FIG. 4, force transfer member 42 has been moved downwardly by the rigid post 44 an amount sufficient to effect tripping or actuation of switch 24 causing the blade 23 thereof to close a circuit between transfer contact 25 and the lower contact 32. In the presently contemplated application of the switch assembly of the present invention, closure of a circuit between contact 25 and contact 32 signals an electronic circuit (not shown) to effect continuous flow of current to a window lift motor for providing downward travel thereof despite the user release of the actuator and deactuation of the switch 24.

It will be understood that user pressure on the rocker dome 48 provides a tactile sense or feel of the increased resistance of movement of the actuator 14 upon deflection of the cantilever spring 38 from the position shown in FIG. 3 to the position shown in FIG. 4. This tactile sensing or "feel" of the additional force required to deflect spring 38 to the FIG. 4 position provides the user with an indication that the first switch 28 has been actuated and prevents unwanted or inadvertent actuation of the second switch 24.

The present invention provides for actuation sequentially of a plurality of snap acting switches by movement of a single rocker-type actuator and absorbs overtravel after actuation of the first to be actuated of the switches by means of deflection of a cantilever spring mounted on the rocker. The present invention provides a unique and novel switch construction in which the user can, by movement of a single rocker, detect actuation of a first of plural sequentially activated switches without unwanted or inadvertent actuation of the second switch.

Although the invention has hereinabove been described with respect to the illustrated embodiments, it will be understood that the invention is capable of modification and variation and is limited only by the scope of the following claims.

I claim:

1. A switch assembly comprising:

(a) housing means;

(b) an actuator member mounted for pivotal movement about a pivot on said housing means and adapted for being user contacted for effecting such movement, said actuator member having thereon overtravel means for absorbing force applied thereto by resilient deflection;

(c) a first and second switch blade member mounted for individual movement on said housing means, and each operable to be moved between a first and second position for effecting opening and closing of a separate set of electrical contacts;

(d) a first force transfer means slidably guided for movement on said housing means and operative upon being contacted by said overtravel means during movement of said actuator member to transmit a force to said first switch blade means for effecting said opening and closing of one of said contact sets;

(e) said actuator means including means defining a contact surface adapted for contact therewith; and, (f) a second force transfer means, slidably guided for movement on said housing means, and operative upon being contacted by said contact surface to transmit a force to said second switch blade means for effecting opening and closing of the other of said contact sets, wherein upon movement of said actuator member sufficient to effect actuation of said first blade member by said overtravel means acting on said force transfer means and continued movement thereafter of said actuator member causes said resilient deflection of said overtravel mans in response to the increased force of resistance applied thereto by said first blade member through said first force transfer means, whereby said overtravel means absorbs overtravel of said actuator member.

2. The switch assembly defined in claim 1, wherein said overtravel means comprises a resilient blade member cantilevered on said actuator member for contact with said first and second force transmitting means.

3. The switch assembly defined in claim 1, wherein said overtravel means comprises a resilient blade member mounted on said actuator member and operative upon movement thereof, to contact said first force transfer means and said second force transfer means sequentially, said blade member having portions thereof movable with respect to said actuator member for absorbing by resilient deflection thereof overtravel movement of said actuator member after effecting actuation of said first switch blade member.

4. A switch assembly comprising:

(a) housing means;

(b) actuator means disposed for user movement on said housing means and including means defining a resilient contact surface and means defining a rigid contact surface;

(c) first and second switch means disposed on said housing, each of said switch means including a blade member movable, upon application of an actuation force thereto, for effecting opening and closing a set of electrical contacts;

(d) said actuator means including rigid force transfer means operable upon user movement of said actuator means to cause said resilient contact surface to effect movement of said first switch means blade member for actuation of said first switch means, and said rigid contact surface is operable to effect movement of said second switch means blade member for actuation of said second switch means, whereupon continued user movement of said actuator means after actuation of said first switch means, continued movement of said actuator means causes resilient deflection of said resilient contact surface in response to the increased force of resistance applied thereto by said first blade member through said force transfer means wherein said resilient contact surface absorbs overtravel of said actuator means.

5. The switch assembly defined in claim 4, wherein said means defining a resilient contact surface comprises a resilient blade member.

6. The switch assembly defined in claim 4, wherein said means defining a resilient contact surface comprises a resilient blade member mounted in cantilever on said actuator means and having said first and second contact surface formed thereon.

7. The switch assembly defined in claim 4, wherein said means defining said first contact surfaces includes energy absorbing means and said force transfer means includes a member disposed for sliding movement on said housing intermediate said energy absorbing means and said first switch means blade member; and, said force transfer includes a second force transfer member disposed for sliding movement on said housing intermediate said second switch means blade member.

8. The switch assembly defined in claim 4, wherein said means defining a resilient contact surface comprises a resilient member cantilevered from said actuator means and having a portion thereof defining said first contact surface; and, said actuator means has an integral portion thereof defining said rigid contact surface.

9. A switch assembly comprising:

(a) housing means;

(b) an actuator member disposed for movement on said housing and including means defining a rigid contact surface and means defining a resiliently deflectable contact surface;

(c) a first switch means having a first movable blade member disposed on said housing means for actuation by said resilient contact surface;

(d) a second switch means having a second movable blade member disposed on said housing means for actuation by said rigid contact surface, wherein upon user movement of said actuator member, said first switch means and said second switch means are sequentially actuated, and said means defining said resilient contact surface absorbs overtravel by resilient deflection upon continued movement of said actuator member after actuation of said first switch means.

10. The switch assembly defined in claim 9, wherein said means defining said resilient contact surface includes a blade member mounted for resilient movement on said actuator member for absorbing said overtravel.

11. The switch assembly defined in claim 9, wherein said means defining said resilient contact surface includes an elongated blade member cantilevered from said actuator member.

12. The switch assembly defined in claim 9, wherein said means defining said resilient contact surface (a) an elongated blade member cantilevered from said actuator member; and, (b) a force transfer member mounted for movement on said housing means and operative for transmitting contact forces from elongated blade member to said first switch means.

13. The switch assembly defined in claim 9, wherein said means defining said rigid contact surface includes a transfer member disposed for sliding movement on said housing means.

14. The switch assembly defined in claim 9, wherein said means defining said rigid contact surface includes a force transfer member mounted for sliding movement on said housing means.

15. The switch assembly defined in claim 9, wherein said actuator member is mounted for pivotal movement about a fulcrum on said housing means; and, said resilient switch contact surface is disposed a greater distance from said fulcrum than said rigid switch contact surface.

* * * * *